United States Patent [19]

Brown

[11] Patent Number: 4,920,678

[45] Date of Patent: May 1, 1990

[54] CONVERSION KIT FOR SEMIAUTOMATIC WEAPONS

[76] Inventor: Michael W. Brown, 215 Steedly Drive, Louisville, Ky. 40214

[21] Appl. No.: 347,225

[22] Filed: May 4, 1989

[51] Int. Cl.[5] ..... F41D 7/03

[52] U.S. Cl. ..... 42/25; 89/128; 89/196

[58] Field of Search ..... 42/25

[56] References Cited

U.S. PATENT DOCUMENTS

| | | | |
|---|---|---|---|
| 16,797 | 3/1857 | Hicks | 42/25 |
| 2,500,139 | 3/1950 | Swebilivs | 42/25 |
| 4,220,071 | 9/1980 | Seiderman | 89/128 |
| 4,531,446 | 7/1985 | VanVoorhees | 89/29 |
| 4,648,192 | 3/1987 | Harness | 42/77 |

*Primary Examiner*—Stephen C. Bentley

*Attorney, Agent, or Firm*—Harpman & Harpman

[57] ABSTRACT

An improvement for a caliber conversion kit for semi-automatic and automatic firearms to allow the use of smaller caliber ammunition within. The conversion kit comprises the replacement of the bolt, barrel and magazine clip of the existing firearm so that the firing speed and thus the action or feel is similar to a standard non-modified firearm having larger caliber ammunition.

4 Claims, 5 Drawing Sheets

FIG. 7
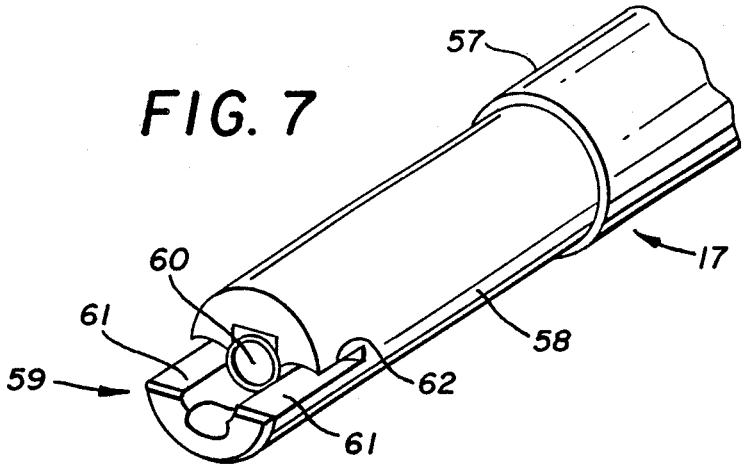
FIG. 8
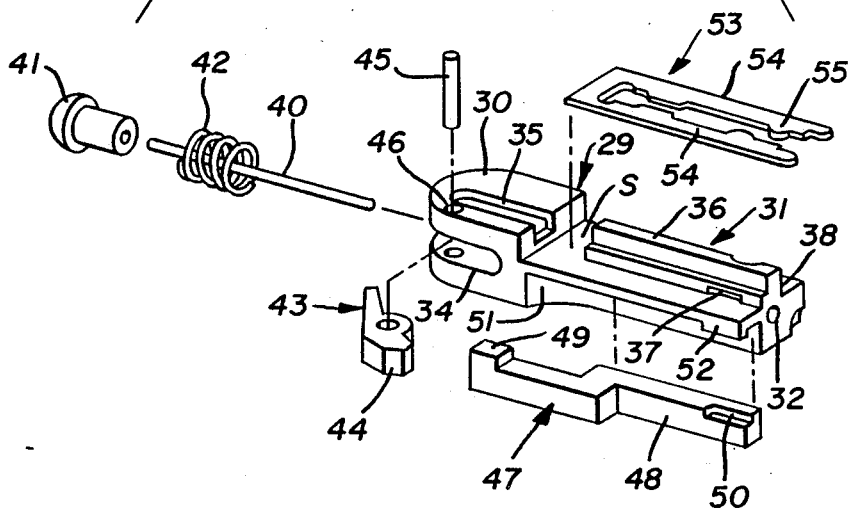
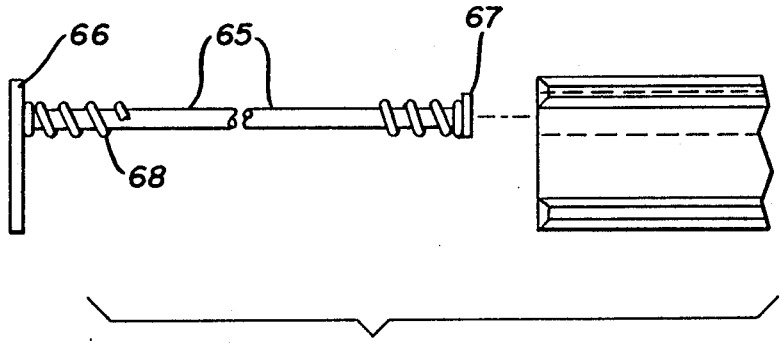
FIG. 9

CONVERSION KIT FOR SEMIAUTOMATIC WEAPONS

BACKGROUND OF THE INVENTION

1. Technical Field

This device relates to conversion kits for semiautomatic weapons of the type that have a relative compact overall size and use 0.9 mm caliber ammunition to be converted for the use of typically 0.22 caliber ammunition.

2. Description of Prior Art

Prior Art devices of this type have relied on a variety of modified bolts and barrel assemblies to convert large caliber weapons to small caliber ammunition, such as 0.9 mm to 0.22. See for example U.S. Pat. Nos. 4,220,071 and 4,648,192 and a conversion kit for an Uzi carbine (IMI- Israel 00020).

In U.S. Pat. No. 4,220,071 a conversion kit is disclosed wherein the barrel, bolt and operation slide and magazine are replaced by modified ones utilizing a converted standard slide by cutting off the weighted forward end portion.

In U.S. Pat. No. 4,648,192 a firearm for firing different caliber ammunition utilizes multiple barrel parts and inserts so that a variety of different size ammunition can be fired utilizing the same basic gun.

In the IMI-Israel 00020 conversion kit, the instruction manual discloses a 0.22 caliber conversion kit comprising a 0.22 caliber barrel, a bolt housing and striker assembly, and a 0.22 caliber magazine assembly. The bolt and striker assembly have a fixed bolt housing with a reciprocating striker bolt movably positioned therein for converting Uzi carbines or the like for use with 0.22 caliber ammunition.

SUMMARY OF THE INVENTION

An improvement in a conversion kit for semiautomatic weapons, such as Uzi and the like wherein a replacement bolt and striker assembly are substituted in combination with a barrel and ammunition magazine that will accept 0.22 caliber ammunition without the usual loss in weapon feel attributed mostly to cycle rate during rapid fire. The bolt and bolt carrier move as a single unit and can be interchanged to other bolt carriers in similar Uzi weapons.

DESCRIPTION OF THE DRAWINGS

FIG. 7 is an enlarged perspective view of a portion of a modified barrel;

FIG. 8 is an enlarged exploded perspective view of the striker bolt of the invention; and FIG. 9 is a side plan view of a portion of the bolt assembly and associated guide rod and reciprocating spring;

DESCRIPTION OF THE PREFERRED EMBODIMENT

Figure 1:
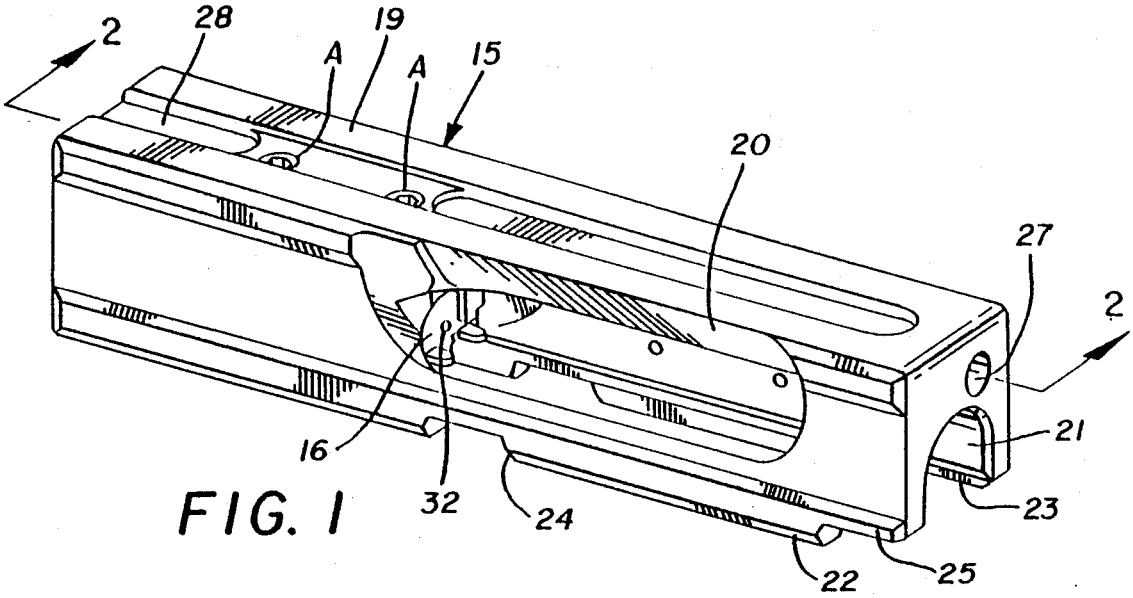
FIG. 1 is a perspective view of a bolt and bolt carrier.
Figure 6:
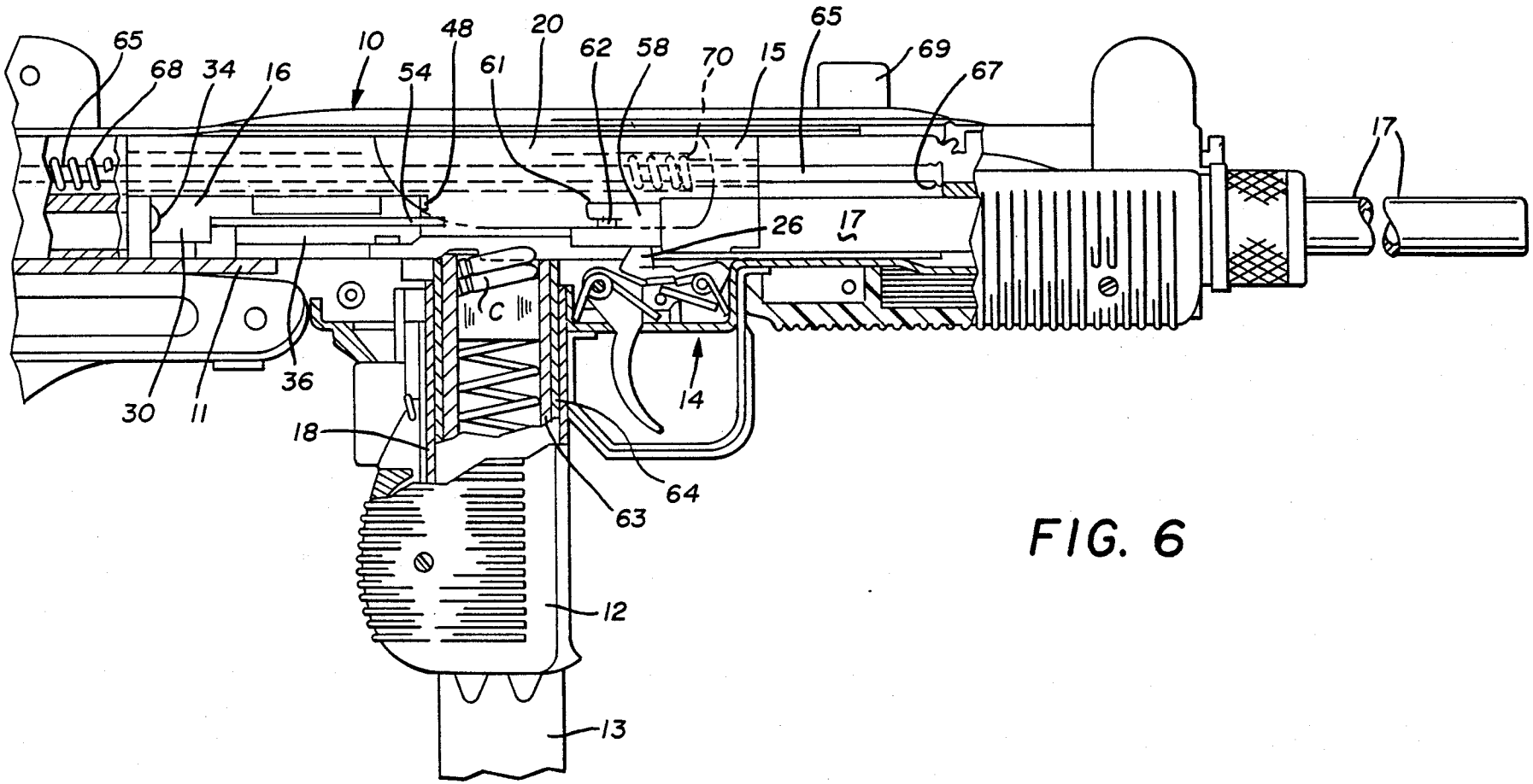
FIG. 6 is a side elevation partially broken away of a semiautomatic Uzi type firearm.
Figure 10:
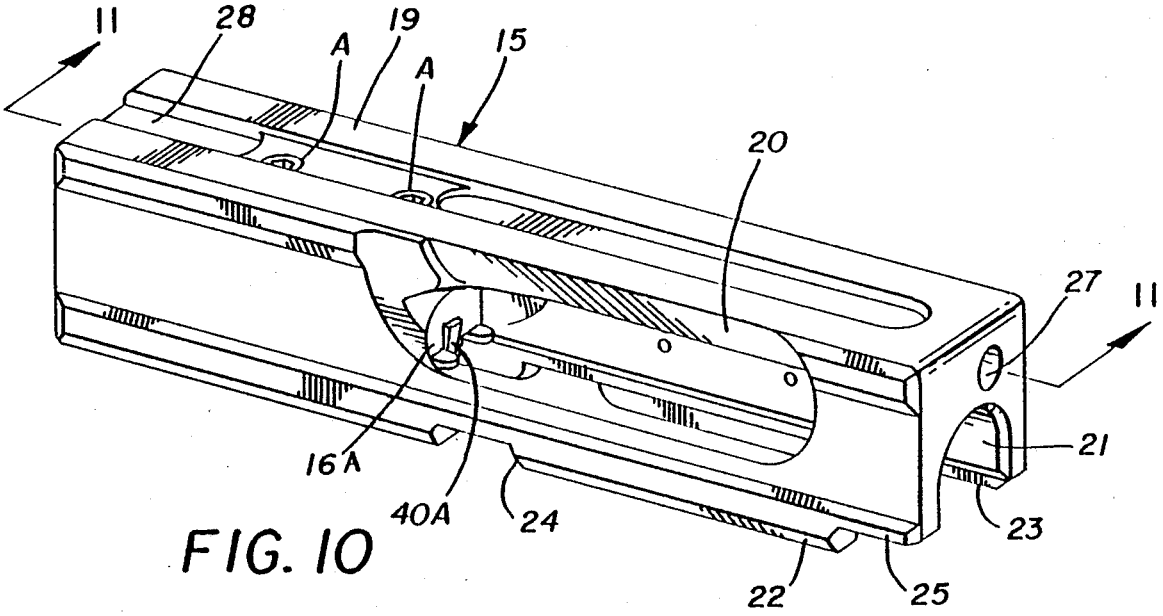
FIG. 10 is a perspective view of an alternate form of the invention showing a modified bolt carrier.
Figure 11:
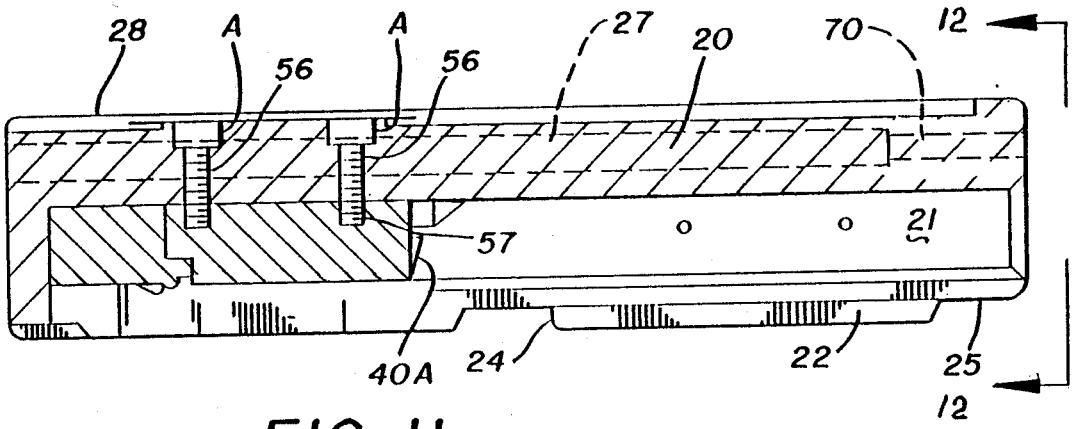
FIG. 11 is a section on lines 11—11 of FIG. 10.
Figure 12:
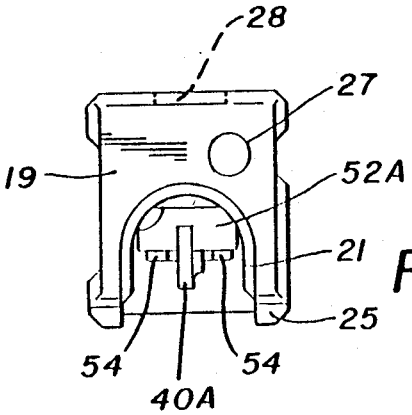
FIG. 12 is an end plan view on lines 12—12 of FIG. 11.

Referring now to FIGS. 1 and 6 of the drawings a semiautomatic weapon is shown having a receiver 10, a main body member 11, a pistol grip 12 with an ammunition or clip (13) within. A trigger assembly 14 can be seen associated with other components that are well known and evident in a Uzi brand automatic firearm as described in detail in U.S. Pat. No. 4,335,643 which by reference becomes part of the disclosure requiring no further explanation to those skilled in the art.

The conversion kit of the invention comprises a bolt housing 15, a striker bolt 16, a modified barrel assembly 17 and a converted ammunition magazine 18, as best seen in FIGS. 1–5 and 7 and 8 of the drawings. The bolt housing 15 and striker bolt 16 are direct replacements for the standard bolt (not shown) in this example in Uzi automatic firearm using standard 0.9 mm caliber ammunition or the like.

The bolt housing 15 is characterized by a generally elongated body member 19 having similar design and structural aspects to the standard bolt housing which it replaces.

The bolt housing 15 has a breech opening 20 and a barrel receiving area 21 seen in FIG. 1 of the drawings. A pair of rails 22 and 23 are formed in the housing adjacent to the recessed area 21 and have locking notches 24 and 25 within which are engageable by a sear 26 in the trigger assembly 14. An elongated spring receptacle bore 27 extends longitudinally the length of the housing 16 above and to the right when viewed in cross-section of said barrel receiving area 21. A recessed area 28 is formed in the uppermost surface of the housing 15 and has a pair of spaced vertically aligned apertures A within intersecting the barrel receiving area 21, best seen in FIG. 2 of the drawings. The striker bolt 16 can be seen in FIGS. 2, 3 and 4 and inverted in FIG. 8 of the drawings and is comprised of a generally rectangular main body member 29 having a round upstanding end portion 30 and a cutaway multiple configured portion 31. A bore 32 extends on an axial centered plane through said end and configured portions 30 and 31 respectively with an area of increased interior dimension at 33 within the end portion 30. A slot 34 is formed horizontally in the side of the end portion 30 intersecting said area of increased dimension at 33. A secondary slot 35 defines a recessed area in the top surface of said end portion and again intersects said area of increased diameter at 33 just below.

The multi-configured portion 31 has an upstanding stepped rib 36 extending inwardly from its free end to a point just short of said end portion 30. The rib 36 has two oppositely disposed undercut curved recesses at 37 and 38 respectively adjacent one end on the same horizontal plane as the top surface. A third curved recess is formed at 39 just above said recesses 37.

A firing pin 40 is movable positioned within said bore at 32 and is engaged in an apertured cylindrical body member with an enlarged conical head 41 within the area of increased interior dimension at 33. A spring 42 is positioned on said cylindrical body member registrably engaged between said conical head 40 and the transition from the area of increased interior diameter 33 and said bore 32. An apertured link 43 having an angularly offset extension 44 is pivotally secured within said slot 34 by a pivot pin 45 extending through aligned apertures 46 therein so as to be registrable with said conical head 41 as hereinbefore described. A firing arm 47 having elongated offset body member 48 with an upstanding engagement member 49 at one end and a rectangular notch at 50 on the other end thereof. The firing arm 47 is slideably positioned in an arm guide recess 51 in the multi-configured portion 31 of the main body member 29 of the striker bolt 16 and is spaced in relation to said multi-configured portion 31's top surface S. An elongated tab 52 extends into said arm guide recess 50 and correspondingly registers with said notch 50 when assembled within said bolt housing 16 as hereinbefore described.

An ejection clip 53 is configured with a pair of extractor arms 54 having arcuate locking tabs 55 in staggered facing portion along the interior edges of said extractor arms 54. Each of the locking tabs 55 engage and seat in the respective and align recesses 37 and 38 and extend outwardly beyond the end face of the striker bolt 16, as best seen in FIGS. 2 and 3 of the drawings.

Figure 2:
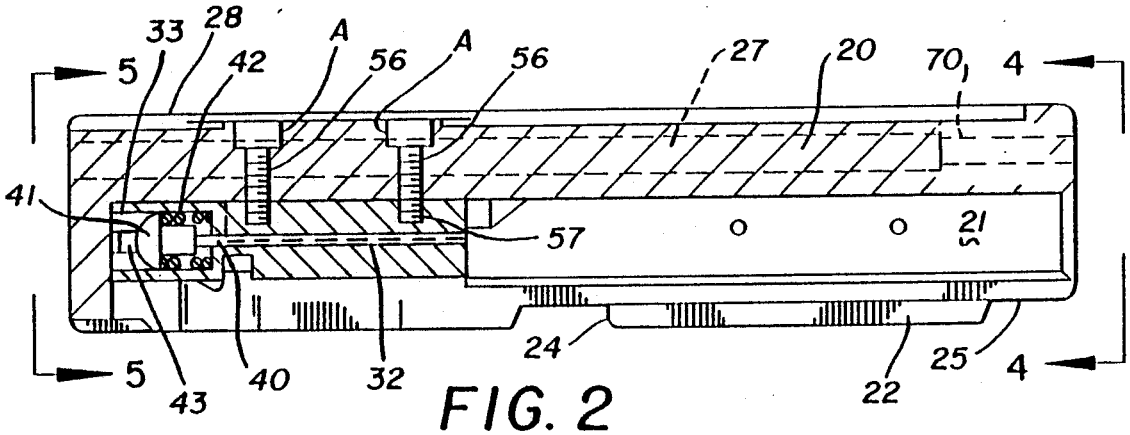
FIG. 2 is a section on lines 2—2 of FIG. 1.
Figure 3:
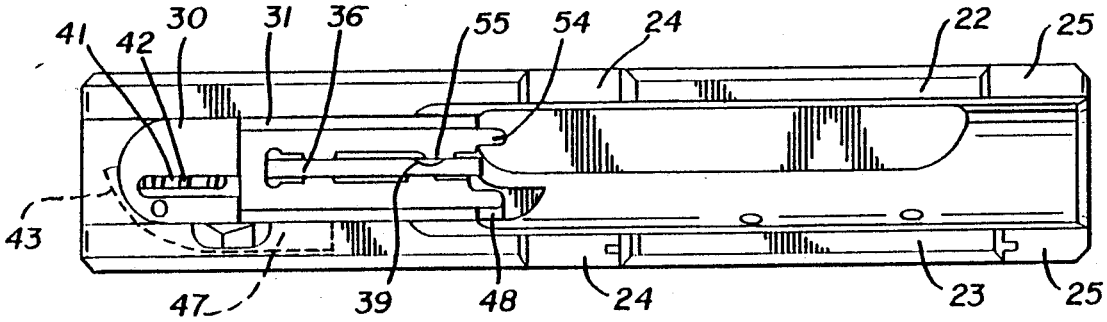
FIG. 3 is a bottom plan view of the bolt and bolt carrier of FIG. 1.
Figure 5:
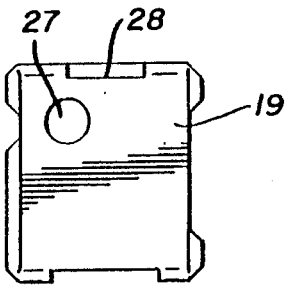
FIG. 5 is an end plan view on lines 5—5 of FIG. 2.
Figure 4:
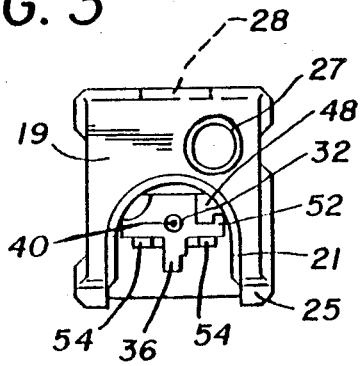
FIG. 4 is an end plan view on lines 4—4 of FIG. 2.

The assembled striker bolt 16 is positioned within the bolt housing 19 and secured therein by a pair of threaded fasteners 56 extending through respective apertures A in the recessed area 28 of the housing 19 and into the respective threaded taps 57 in the multi-configured portion of the striker bolt 16 as seen in FIGS. 1 and 2 of the drawings.

Referring now to FIG. 7 of the drawings, an enlarged portion of the conversion barrel 17 is shown having a main barrel body member 57 and an area of reduced diameter at 58 with a striker bolt registration area 59. A 0.22 caliber rifle bore 60 is formed along the longitudinal center axis of said barrel 17 with a cutaway portion defining oppositely disposed ejector guide surfaces 61 extending via slots 62 into the main barrel body member 58.

Referring to FIG. 6 of the drawings, the barrel 17 can be seen in adjacent spaced relation to the face of the striker bolt 16 in the assembled cocked position of the weapon. The extractor arms 54 will register on the ejector guide surface 61 and extend into the slots 62 for engagement with a cartridge C in the firing chamber (not shown) defined within the barrel 17 as hereinbefore described.

The converted ammunition magazine 18 is best described as a 0.22 caliber spring biased ammunition clip 63 inserted into a shell 64 of a 0.9 mm standard size Uzi type magazine clip so that the proper alignment of the 0.22 caliber ammunition will be presented for engagement with the striker bolt 16 in the bolt housing 19 in the same manner as a standard Uzi type semiautomatic firearm as disclosed in U.S. Pat. No. 4,335,643 made of reference.

Referring now to FIGS. 2, 6 and 9 of the drawings, a spring guide rod 65 can be seen having a buffer plate 66 on one end and a spring stop 67 on the other end thereof. A spring 68 is positioned on said guide rod and the assembly is then positioned within the spring bore 27 of the bolt housing 15.

In operation, the conversion kit functions as a typical Uzi semiautomatic firearm wherein the firearm is first manually cocked by pulling back against a cocking knob 69 drawing the bolt housing 15 and associate striker bolt back against the spring 68 by engagement of the bolt housing 16 with a shoulder 70 in the spring bore 27 as illustrated in FIG. 6 of the drawings. The cocking action is similar to firearms of this type and will be well known and understood by those skilled in the art.

It will be evident that during operation that since the striker bolt 16 and the bolt housing 15 move as a single unit unlike that of a standard Uzi firearm that the cycle rate for the firearm will be equal to that of a non-modified firearm utilizing the 0.9 mm type ammunition which has a fixed housing and a movable bolt.

Since the striker bolt 16 of this invention is configured to fit a Uzi type firearm, it can be placed in other Uzi firearm models, such as the mini or micro Uzis widely used by the law enforcement agencies and others throughout the world.

Referring now to FIGS. 10–14 of the drawings, an alternate form of the invention can be seen comprising a modified striker bolt 16A in which the original bore 32, firing pin 40, slot 34 and associated assembly parts including spring 42, aperture length 43, associated offset extension 44, pivot pin 45, firing arm 47 are eliminated.

The modified striker bolt 16A has a modified configuration comprising an enlarged tab 52A and a tapered firing pin protrusion 40A. This alternate form of the invention would reduce the overall complexity and cost while still maintaining all of the advantages hereinbefore described of the conversion kit.

Figure 13:
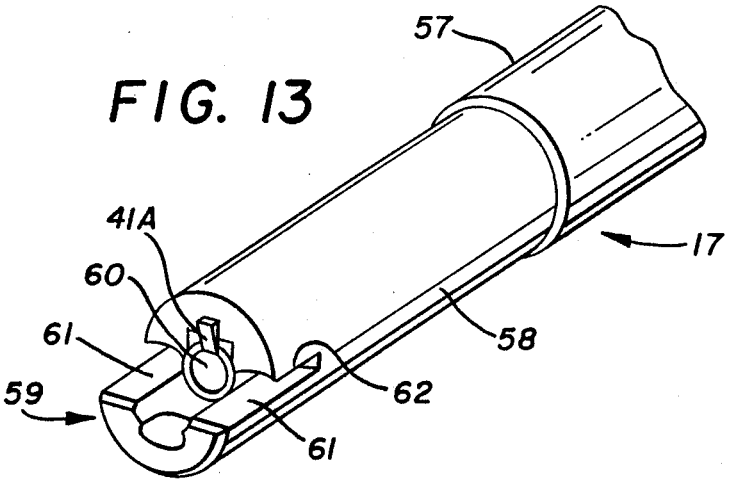
FIG. 13 is an enlarged perspective view of a alternate form of the invention defining a secondary alternate modified barrel configuration.
Figure 14:
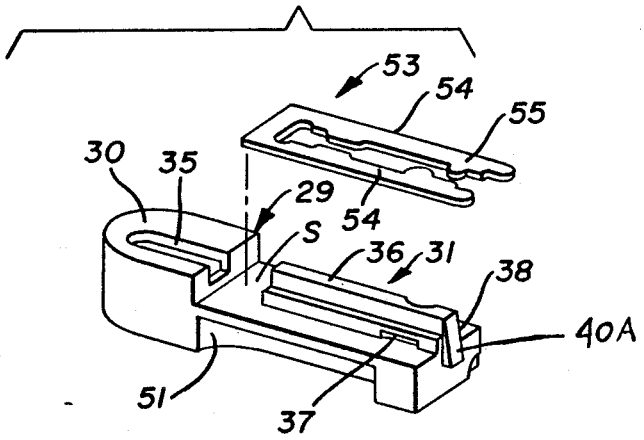
FIG. 14 is an enlarged exploded perspective view of a striker bolt of the alternate form of the invention.

A secondary alternate form of the invention can be seen in FIG. 13 of the drawings in which a tapered firing pin protrusion 41A can be seen on the barrel 58. In this modification, the tapered firing pin protrusion 40A on the striker bolt 16 is eliminated.

Thus, it will be seen that a new and useful modification to a conversion kit for semiautomatic firearms of this type has been illustrated and described and it will be apparent to those skilled in the art that various changes and modifications may be made therein without departing from the spirit of the invention.

Therefore, I claim:

1. An improvement to a caliber conversion kit for semiautomatic firearms having original replaceable barrel, an original replaceable ammunition clip, an original replaceable bolt assembly before the modification to small caliber ammunition use, the improvement comprises in combination a replacement barrel of a reduced caliber bore, a replacement bolt assembly for the original bolt assembly, said replacement bolt assembly comprises a bolt housing and a striker bolt assembly affixed in said bolt housing, said striker bolt assembly comprising a multi-portioned main body member, one of said portions being multi-configured with an upstanding stepped rib, a bifurcated ejection clip engageable on said rib, a tapered firing pin protrusion positioned on one end of said upstanding stepped rib, said tapered firing pin protrusion is tapered outwardly from a free end of said stepped rib to an end face of said striker bolt below said upstanding stepped rib, means for engaging said tapered firing pin protrusion, and means for registering said striker bolt with one end of said replacement barrel.

2. The improvement in a caliber conversion kit for Uzi firearms of claim 1 wherein said bolt housing comprises an elongated body member, a breech opening within said housing, a spring reciprocal bore within said housing, a barrel receiving area extending inwardly from one end thereof.

3. The improvement in a caliber conversion kit for Uzi firearms of claim 1 wherein said means for engaging said tapered firing pin protrusion comprises reciprocation of said striker bolt within said bolt housing.

4. The improvement in a caliber conversion kit for semiautomatic firearms of claim 1 wherein said means for registering said striker bolt with an end of said replacement barrel comprises oppositely disposed ejector guide surfaces and slots in one end of said replacement barrel aligned for intermitten registration with said bifurcated ejector clip.

* * * * *